United States Patent [19]

Bastien et al.

[11] 4,173,523

[45] Nov. 6, 1979

[54] CATHODIC PROTECTION OF A STRUCTURE IN THE SEA BY SACRIFICIAL ANODES

[75] Inventors: Joël Bastien, Toulouse; Jaime Gratacos, Morlaas; Flavien Lazarre, Pau, all of France

[73] Assignee: Societe Nationale Elf Aquitaine (Production), Paris, France

[21] Appl. No.: 832,472

[22] Filed: Sep. 12, 1977

[30] Foreign Application Priority Data

Sep. 13, 1976 [FR] France ..... 76 27443

[51] Int. Cl.[2] ..... C23F 13/00

[52] U.S. Cl. ..... 204/197

[58] Field of Search ..... 204/197, 148

[56] References Cited

U.S. PATENT DOCUMENTS

| | | | |
|---|---|---|---|
| 2,490,978 | 12/1949 | Osterheld | 204/148 |
| 2,571,062 | 10/1951 | Robinson et al. | 204/197 |
| 3,321,306 | 5/1967 | Reding et al. | 204/148 |
| 3,537,963 | 11/1970 | Schrieker | 204/197 |
| 3,953,311 | 4/1976 | Wasson | 204/197 |

*Primary Examiner*—Howard S. Williams

*Attorney, Agent, or Firm*—Brisebois & Kruger

[57] ABSTRACT

Apparatus and system for cathodic protection of a metal structure in the sea by sacrificial anodes. The apparatus has at least one anode of a first type for which the current flow is greater than 10 Amperes/meter$^2$, with potentials on the order of −900 mV/ECS and has at least one anode of a second type for which the current flow is less than 6 Amperes/meter$^2$, with potentials in the order of −900 mV/ECS, the absolute values of the decomposition potential under load of the anodes of the first and of the second type being greater (more negative) than the absolute value of the potential of the protected structure. Such a system can assure the protection of a metal structure in the sea for several dozen years.

4 Claims, No Drawings

CATHODIC PROTECTION OF A STRUCTURE IN THE SEA BY SACRIFICIAL ANODES

The present invention relates to apparatus for cathodic protection of metal structures in the sea.

The known process for cathodic protection of metal structures, submerged in sea water, imposes on the said structures a potential so great that all corrosive progress is eliminated.

In a known technique for cathodic protection, at least one anode which is not active by itself, for example of iron or of graphite, is connected to the structure to be protected by an electrical conductor in which is inserted a source of continuous electrical current. The current applies a difference of potential between the anodes and the structure to be protected, thus placing the structure at the desired non-corrosion potential. The source of continuous electrical current must operate continuously for the entire period during which the structure must be protected, that is, for the life of the structure. Such a requirement is the basis of significant considerations both in the equipment design, for example, two parallel systems must be installed for safety reasons, and in the system for supplying the source of electrical current with energy, usually in the form of fuel to drive a generator.

Another device in use includes at least one reactive anode having a spontaneous potential sufficiently electronegative, so that, being connected to the submerged metal structure by an electrical conductor, the anode furnishes the current necessary to bring the structure to the non-corrosion potential. The reactive anodes, connected to the structure, by using themselves up, furnish the necessary energy for this protection. They are called consumable or sacrificial anodes.

The spontaneous potential of steel in sea water, variable as a function of local conditions, is near −700 mV in relation to a standard saturated calomel electrode (abbreviated ECS).

The potential of cathodic protection varies also as a function of the same parameters characteristic of local sea water conditions; −900 mV/ECS is considered to be a value which assures good protection.

The spontaneous potential of metals and alloys in sea water is generally between the following limits:

Aluminum alloys: −1.1 to −1.20 V
Zinc and alloys of zinc: −1.1 to −1.15 V
Magnesium: −1.5 to −1.7 V The coupling of anodes, made of these metals, with steel, in a surface ratio of anode to cathode, of 1/50, gives the following values in a laboratory:

alluminum alloy anodes: −1 to −1.07 V/ECS
zinc alloy anodes: −1 to −1.05 V/ECS
magnesium anodes: −1.2 V These spontaneous potentials represent, in relation to the value of the potential for the protection desired of −900 mV/ECS, an over-protection of 100 to 200 mV which is a large waste of current.

In designing anodes to resolve this problem, one encounters the four following obstacles:

1—Offsetting the large current flow necessary during the first weeks of starting the cathodic protection.

2—Making all the anodes share in the current flow during this same period.

3—Assuring a sufficient protection for a duration of 10 to 20 years without any maintenance.

4—Achieving a potential of the system on the order of −900 mV/ECS

The anodes which were tested do not satisfy the four conditions simultaneously, because they fall into two categories:

(a) anodes furnishing very large current flow at very electronegative potentials.

(b) anodes furnishing limited current flow from a certain potential.

The use of anodes of type (a) will satisfy conditions 1,2 and 3 but not condition 4.

The use of anodes of type (b) will satisfy conditions 2,3 and 4 but not condition 1, unless this deficiency is compensated for by a very large multiplication of anodes and is thus incompatible with economic considerations.

A device according to the invention for cathodic protection of a metal structure in the sea, by means of sacrificial anodes which are submerged and which are joined by electrical conductors to the metal structure, comprises at least one sacrificial anode of a first type for which the current flow is greater than 10 A/meter$^2$ with potentials on the order of −900 mV in relation to a standard saturated calomel electrode (saturated potassium chloride solution saturated with mercurous chloride) and at least one sacrificial anode of a second type for which the current flow is less than 6 A/meter$^2$ for potentials on the order of −900 mV in relation to a standard saturated calomel electrode, the absolute values of the decomposition potential under load of the anodes of the first and of the second type being greater than the absolute value of the potential of the protected structure.

In preferred embodiments, the anodes of the first and of the second type are aluminum anodes with 0.3 to 6% zinc or cadmium, and 0.02 to 0.2% of mercury, the anodes of the first type containing less than 0.005% of magnesium and less than 0.005% of copper, and the anodes of the second type containing 0.5 to 10% of magnesium and 0.1 to 1.0% of copper.

In an embodiment satisfying the most difficult conditions of use, each anode of the first type comprises a casing encircling each anode of the second type.

The invention will be better understood from chemical analysis and values for the principal technical characteristics of different anodes of Aluminum (A,B,C,D) presented for illustration (non-limiting) and pertaining to the first type (A,B) and to the second type (C,D) of anodes.

TABLE

| | First type (a) | | Second type (b) | |
|---|---|---|---|---|
| | A | B | C | D |
| Zinc % | 0.35–0.50 | 1–5 | 0.1–0.4 | 3–5 |
| Mercury % | 0.035–0.048 | 0.06–0.15 | 0.08–0.15 | 0.03–0.1 |
| Magnesium % | | | 6–8 | 0.5–0.8 |
| Copper % | | | 0.15 | 0.4 to 0.8 |
| Iron | <0.08 | <0.12 | <0.4 | <0.5 |
| Manganese | | 0.1–0.5 | <0.6 | <0.6 |
| Silicon | 0.11–0.21 | | <0.3 | <0.3 |
| Decomposition Potential under load ($Cu$-$SO_4Cu$ saturated*) | −1.10 | −1.12 | −1.13 | −1.15 |
| Curent Density | | | | |

TABLE-continued

| | First type (a) | | Second type (b) | |
|---|---|---|---|---|
| | A | B | C | D |
| $A/m^2$ | 16.5 | 11 | 5.5 | 2.2 |

(*)The decomposition potential under load is given in relation to a reference electrode consisting of a copper metal electrode immersed in a saturated $CuSO_4$ solution.

It is apparent that percentages less than 0.6% of iron, manganese or silicon do not have appreciable influence on the technical characteristics which distinguish anodes of the first type from anodes of the second type.

Anodes of both types can take forms which are customarily given to sacrificial anodes.

One particular embodiment consists of associating the anodes of the first type (a) with anodes of the second type (b) in such a way that the anode of the first type forms a casing going around each anode of the second type. This can be accomplished either by two successive castings, first of a core comprising the anode of the second type, and then of a casing comprising the anode of the first type, or by shrinking-on of an anode of the second type inside a previously formed cylindrical cavity of an anode of the first type.

The major advantage of such an arrangement, with an anode of the first type forming a casing around an anode of the second type, resides in the guarantee thus furnished that the anodes of the second type will enter into contact with the sea water only after complete dissolution of the casing of the first type and that therefore they will commence their dissolution phase without having undergone the risk of receiving a surface deposit or having undergone unforseen passivation. Such an embodiment is particularly adapted to the most difficult conditions of use, notably in particularly turbid seas.

The embodiments disclosed do not require an external current source in the cable connecting the anodes to the protected structure, and the system is very reliable.

What is claimed is:

1. A system for cathodic protection of a metal structure in the sea, by means of submerged sacrificial anodes which are joined by electrical conductors to the metal structure, comprising at least one sacrificial anode of a first composition for which the current output is greater than 10 Amperes per square meter with potentials on the order of −900 millivolts in relation to a standard saturated calomel electrode, and at least one sacrificial anode of a second composition different from the first for which the currentoutput is less than 6 Amperes per square meter for potentials on the order of −900 millivolts in relation to an electrode of saturated calomel, and wherein the anodes of the first and of the second composition are aluminum anodes with 0.3 to 6% zinc or cadmium, and 0.02 to 0.2% of mercury, the anodes of the first composition containing less than 0.005% of magnesium and less than 0.005% of copper, the anodes of the second composition containing 0.5 to 10% of magnesium and 0.1 to 1.0% of copper, the absolute values of the decomposition potential under load from the anodes of the first and of the second composition being greater than the absolute value of the potential of the structure to be protected.

2. A system according to claim 1, wherein said sacrificial anode of said first composition comprises a casing surrounding and protecting said sacrificial anode of said second composition.

3. A system according to claim 2, wherein said casing prevents contact of the anode of said second composition with the sea until said casing dissolves.

4. A system according to claim 1, wherein said anode of said second composition comprises means for protecting the metal structure for a time period on the order of 10 to 20 years.

* * * * *